United States Patent [19]

Helm et al.

[11] 4,151,017

[45] Apr. 24, 1979

[54] METHOD OF PRODUCING HEAT-RESISTANT PARTS

[75] Inventors: Siegfried Helm, Petershausen; Peter Leven, Allershausen, both of Fed. Rep. of Germany

[73] Assignee: Maschinenfabric Augsburg-Nurnberg Aktiengesellschaft, Munich, Fed. Rep. of Germany

[21] Appl. No.: 791,749

[22] Filed: Apr. 28, 1977

[30] Foreign Application Priority Data

May 7, 1976 [DE] Fed. Rep. of Germany ..... 2620197

[51] Int. Cl.[2] ..... B22F 3/24

[52] U.S. Cl. ..... 148/126; 148/4; 148/13.1

[58] Field of Search ..... 148/4, 12.1, 13.1, 126, 148/11.5; 427/250, 374, 248 E

[56] References Cited

U.S. PATENT DOCUMENTS

| | | | |
|---|---|---|---|
| 2,989,428 | 6/1961 | Rymer | 148/13.1 |
| 3,102,044 | 8/1963 | Joseph | 427/374 E X |
| 3,310,440 | 3/1967 | Piearcey | 148/13.1 |
| 3,528,861 | 9/1970 | Elam | 148/11.5 Q |
| 3,765,958 | 10/1973 | Freche et al. | 148/126 |
| 3,977,915 | 8/1976 | Greenwood | 148/13.1 |
| 3,999,954 | 12/1976 | Kolaska et al. | 148/126 |
| 4,034,142 | 7/1977 | Hecht | 252/250 |

*Primary Examiner*—G. O. Peters

*Attorney, Agent, or Firm*—Alan H. Levine

[57] ABSTRACT

A part is formed of a metal-base material having high heat-resistance. The part may be formed by sintering or sinter forging. The part is provided with a skin formed of a material having a melting point above the melting point of the material of which the part is formed. The skin-bearing part is then heat treated in a vacuum at a temperature near the melting temperature of the material of which the part is formed, but below the melting temperature of the skin material. The skin material may be evaporable and precipitated from a gaseous phase on to the part. Precipitation may take place at the heat treatment temperature. The part preferably shrinks during heat treatment so as not to put tensile stress on the skin.

6 Claims, 3 Drawing Figures

Figure 1:
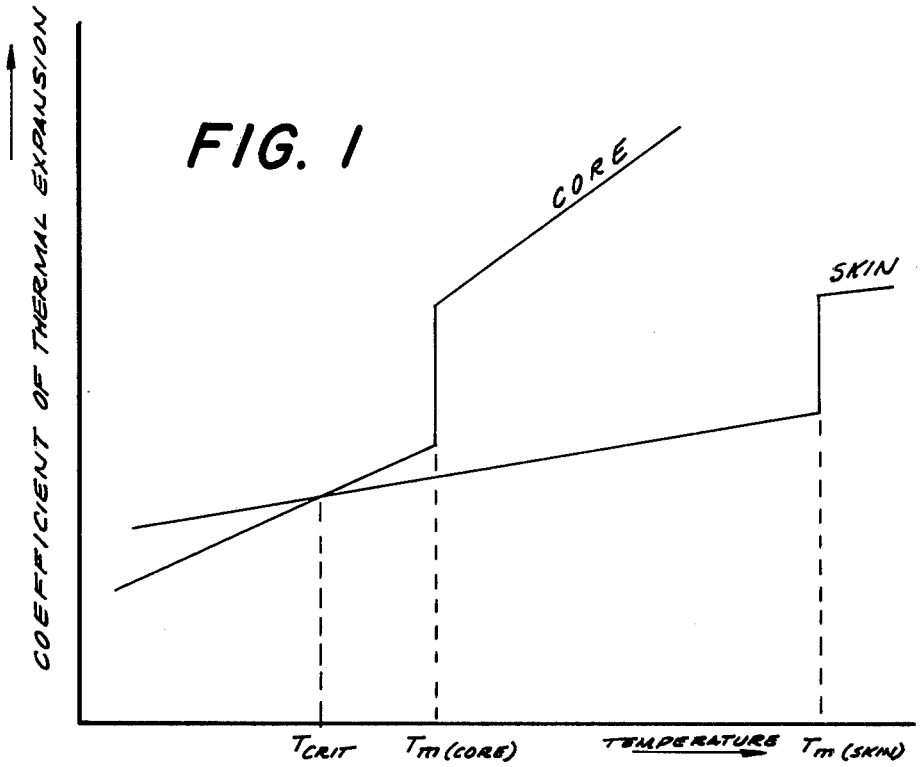

COEFFICIENT OF THERMAL EXPANSION
CORE
SKIN
$T_{CRIT}$
$T_m$ (CORE)
TEMPERATURE
$T_m$ (SKIN)

EXPANSION
CORE
$T_m$ (CORE)
TEMPERATURE

METHOD OF PRODUCING HEAT-RESISTANT PARTS

The performance of gas turbines is influenced by, among other factors, their operating temperatures, and performance improves with rising temperature to a remarkable degree. The operating temperatures of gas turbines commonly reach 850° C. and more at the center of the turbine blade. For this reason, blades and other thermally stressed parts of gas turbines are manufactured from highly heat-resistant materials. These are nickel-base and/or cobalt-base alloys, one of the best known among them being Inconel 100.

An essential characteristic of material subjected to such stresses is their fatigue or creep strength. This strength varies largely with the structure of the material. A known method of affecting the structure is that of heat treatment.

It has been common practice to perform heat treatments at very high temperatures in the vicinity of the melting point of the alloys being treated. Such treatment improves the creep strength of the alloys involved by producing a desirable coarse grain. Heat treatment at a temperature in the vicinity of the melting point, however, means that the material is treated in a range in which it becomes soft and doughy. If the temperature exceeds the melting point, the material becomes a liquid. Both conditions mean that the desired shape of the workpiece under heat treatment can be changed as a result mainly of gravity and surface tension. The problem presented by gravity can be eliminated by performing the heat treatment in a gravity-free vacuum, as perhaps in outer space, so that when heat treating in the vicinity of the melting point the only precaution still to be taken would be to prevent surface tension and thermal stress, whcn are relatively small forces compared with gravity, from exercising their deforming influence. While heat treatment in outer space would still be attended by microgravitations, these obviously are very modest and therefore negligible. The forces involved run from $10^{-4}$ g to $10^{-6}$ g, where g is the acceleration due to gravity.

It is a general object of the present invention to provide a method for heat treating components of highly heat resistant materials at extremely high temperatures in the vicinity of the melting point of the materials without running the risk of the components under treatment beginning to flow and thereby losing their shapes.

It is a particular object of the present invention to provide a method for heat treating material in a vacuum at temperatures near the melting point of the material, wherein the not-yet heat treated, but otherwise finished and dimensionally complete, component is provided with a supporting skin enveloping the component to maintain its shape at the treatment temperature.

Another object of the present invention, therefore, is to coat, for heat treatment in a vacuum, components such as gas turbine blades which may have been pre-finished on earth, with a thin, skin-like layer, the melting point of the layer being so high that it retains sufficient strength at the heat treatment temperatures to absorb the load resulting from surface tension, thermal stress, and perhaps microgravitation at weightlessness conditions, such as in outer space, under which the heat treatment takes place.

A particular feature of the invention involves the possibility of coating sintered blades with the aid of the so-called CVD process. This process is a conventional method of precipitation from a gaseous phase, as described, e.g., by H.E. Hintermann and H. Gass. When a component coated in accordance with the method of the present invention is heated, one of the essential problems posed will be that of different thermal expansions of the component, or core, and the skin. FIG. 1 is a schematic arrangement of possible actual conditions, with the coefficients of thermal expansion of core and skin material plotted against temperature, the thermal expansion of the core here exceeding that of the skin. This situation is normal for metallic combinations because with metals the coefficient of thermal expansion generally diminishes as the melting point rises. At the temperature $T_{crit}$, which is the temperature at which the expansion curves of the two materials intersect, the residual stress condition of the system will therefore be reversed. As long as the operating temperature T is less than $T_{crit}$, the skin is under compressive stresses. However, when T exceeds $T_{crit}$, the skin is under (unfavorable) tensile stresses. This is another stress component superimposed on the ones mentioned above.

When the skin is applied in accordance with the present invention at a temperature $T < T_{m(core)}$, which is the melting temperature of the core, it will come under tensile stresses whenever in the temperature range intended for heat treatment. And should the skin in accordance with the present invention be used as a crucible for a remelting processes, this will considerably increase the load on it. These difficulties can be avoided or at least minimized, if according to a further feature of the present invention use is made of a sintered core to be melted in the course of the overall process. But it will first be shown how the use of the CVD process makes it possible to adjust $T_{crit}$.

In the CVD process the material of the skin is brought to the core material, or substrate, in the form of a readily evaporable chemical compound. The compound is then dissociated, and the product of dissociation precipitated on the substrate constitutes the matter forming the skin. In this way, the skin is not produced until the skin-forming material is at the treatment temperature. But at this temperature, here called $T_{CVD}$, the internal stress condition of the skin, as will readily become apparent from FIG. 1, equals zero. Under these conditions, then, $T_{CVD} = T_{crit}$. $T_{CVD}$, or the temperature at which the CVD process takes place, was shown by past experience to be variable within fairly liberal limits. This makes it possible to shift $T_{CVD}$ and, thus, $T_{crit}$ as close as possible to $T_m$ (core). This puts the residual stressed in a good starting position.

Figure 2:
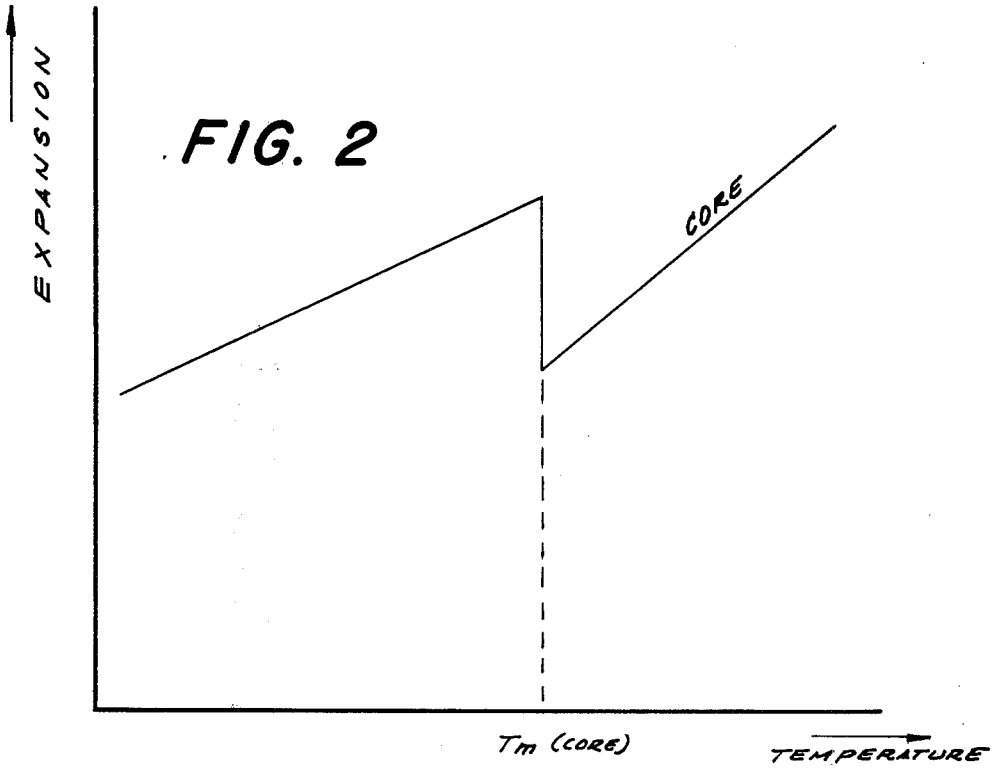

When the core, or the actual workpiece, which may be a gas turbine blade, is manufactured by sintering employing, in particular, a sinter forging process, it is possible to minimize tensile stresses in the skin or, provided the two materials are selected properly, prevent them altogether. It should here be remembered that a sintered molded part is not completely solid but that it instead contains pores of a certain volume, which change in volume upon melting. The change in volume at $T_{m\,(core)}$ follows the following equation:

$$\Delta V = \Delta V_M - \Delta V_P$$

where $V_M$ = change in volume of metallic base material $V_P$ = change in volume due to change in porous portion When $\Delta V_P > \Delta V_M$ the part will contract during melting. When $\Delta V_P < \Delta V_M$ it will grow, and when $\Delta$ $V_P = \Delta V_M$, the melting process will not be reflected at all on the thermal expansion curve. The thermal expansion curve of a part where $\Delta V_P > \Delta V_M$ is shown in FIG. 2. the contraction in volume at $T_{m\ (core)}$ can be utilized to generate especially favorable stress conditions for the skin.

Figure 3:
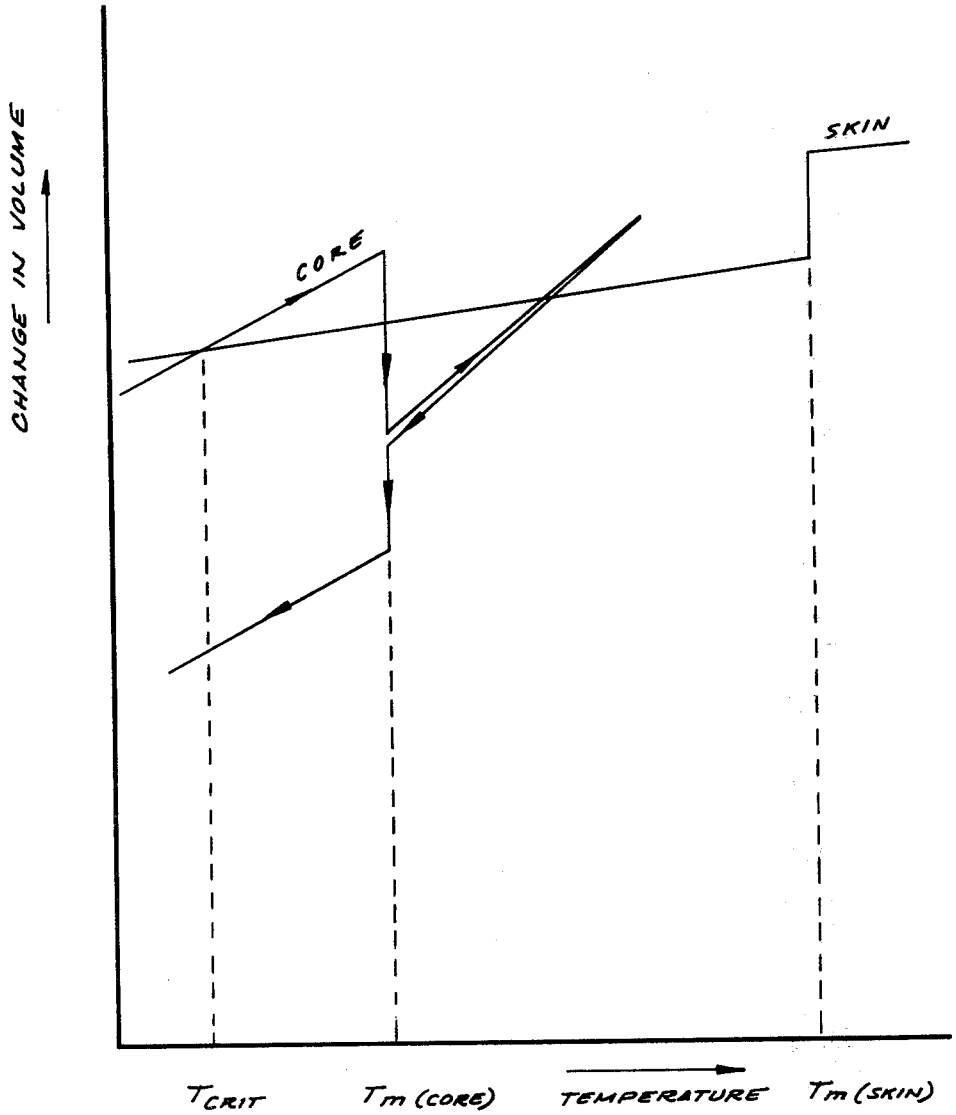

This will become apparent from FIG. 3, where the response of the core during heating and cooling is illustrated together with the response of the skin. It will be seen that the skin is subjected to tensile stresses only in the relatively narrow temperature range between $T_{crit}$ ($=T_{CVD}$) and $T_{m\ (core)}$ and only during heating. The core melting process causes the stress conditions in the skin to reverse to compressive stresses, which is a benefit. The sintered core responds irreversible at the melting point. As with melting, it will contract also during solidification since, at such time, it responds like a compact metal. This places the skin under greater compressive stresses when the entire system is allowed to cool. The magnitude of contraction in volume at the melting point of the sintered core varies with its porous volume. The latter, however, can be varied within wide limits by means of the level of the molding pressure used in the manufacture of the unsintered molded shape. The use of a sintered preform, or of the sintered molded part before treatment by the CVD process, as the core thus permits close adaptation to the thermal expansion of the skin. Considering also that compressive stresses in the surface of components normally have a very beneficial effect, this affords an opportunity to manufacture turbine blades, and other highly-stressed components, for composite materials expected to give especially desirable mechanical properties.

Suitable for use in accordance with the present invention are certain components, especially turbine blades from nickel-base alloys manufactured by sintering and, more particularly, by sinter forging. Suitable for the CVD process applied in accordance with the present invention are the following materials for their ability to be deposited on a great variety of substrates, or molded shapes as is here the case.

Materials Precipitable by the CVD Process

Metals: Cu, Be, Al, Ti, Zr, Hf, Th, Ge, Sn, Pb, V, Nb, Ta, As, Sb, Bi, Cr, Mo, W, U, Re, Fe, Ci, Ni, Ru, Rh, Os, Ir, Pt.

Carbides: $B_4C$, SiC, TiC, ZrC, HfC, ThC, $ThC_2$, TaC $Ta_6C_5$, CrC, $Cr_4C$, $Cr_3C_2$, MoC, $Mo_2C$, WC, $W_sC$, VC, $V_2C_3$, $VC_2$, NbC.

Nitrides: BN, TiN, ZrN, VN, NbN, TaN.

Borides: $AlB_2$, $TiB_2$, $ZrB_2$, $ThB_4$, ThB, NbB, TaB, MoB, $Mo_3B_2$, WB, $Fe_2B$, FeB, NiB, $Ni_3B_2$, $Ni_2B$.

Silicides: Different Silicides of Ti, Zr, Nb, Mo, W, Mn, Fe, Ni, Co.

Oxides: $Al_2O_3$, $SiO_2$, $ZrO_2$, $Cr_2O_3$, $SnO_2$.

Up to this point, the description of the present invention has not considered the fact that many materials exhibit polymorphous transformations which reflect on the thermal expansion curves as changes in volume (expansions or contractions). This fact can safely be ignored, however, since the sudden change in volume at $T_{m\ (core)}$ is variable within wide limits. Should one, or even several, polymorphous transformation occur with one or both materials of the system, which would be indicated by the dilatometric curve, such transformation would then have to be considered.

Also, there still remains the problem of where the contents of the pores will go when the sintered preform melts inside the skin. Such contents comprise the atmosphere in which the preform was pressed or sintered. This problem is obviated if the preform is made and CVD treated in a vacuum. If it is made or treated in any type of atmosphere, however, a skin should be selected which is permeable to gas at least at $T_{m(core)}$.

In sum, then, it is apparent that the method of the present invention provides especially desirable results in that the vitally important control of the core volume is achieved with the aid of sintered preforms.

The present invention permits the manufacture of components from composite materials exhibiting high compressive stresses at the surface. Such components will generally provide good fatigue strength and superior static strength (yield point) as well as adequate resistance to stress corrosion.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A method of producing a part of heat-resistant material, comprising the steps of:
   (a) forming a non-polymorphous metal-base part by means of a sintering operation,
   (b) providing the part by vapor deposition with a skin formed of a non-polymorphous material having a melting point above the melting point of the material of which the part is formed, and
   (c) heat treating the skin-bearing part in a gravity-free condition at a temperature near the melting point of the material of which the part is formed, the temperature being high enough to cause the material of the part to soften and to cause the part to contract but the temperature being below the melting point of the skin material so that the skin maintains the shape of the part during the heat treatment and the skin is under compressive stress due to contraction of the part.

2. A method as defined in claim 1 wherein the part is formed by sinter forging.

3. A method as defined in claim 1 wherein the part is melted during the heat treatment, the skin retaining the shape of the melted part.

4. A method as defined in claim 1 wherein said deposition takes place at a temperature below the melting point of the material of which the part is formed.

5. A method as defined in claim 1 wherein said deposition takes place at a temperature near the melting temperature of the material of which the part is formed.

6. A method as defined in claim 1 wherein the part is melted during the heat treatment so as to cause the part to contract.

* * * * *